US007661512B2

(12) United States Patent
Feldmiller, Jr. et al.

(10) Patent No.: US 7,661,512 B2
(45) Date of Patent: Feb. 16, 2010

(54) PUMP JACK AND METHOD

(75) Inventors: Richard E. Feldmiller, Jr., Sharon, PA (US); Robert D. Beggs, Stoneboro, PA (US)

(73) Assignee: Werner Co., Greenville, PA (US)

( * ) Notice: Subject to any disclaimer, the term of this patent is extended or adjusted under 35 U.S.C. 154(b) by 535 days.

(21) Appl. No.: 11/122,419

(22) Filed: May 5, 2005

(65) Prior Publication Data

US 2005/0263350 A1 Dec. 1, 2005

Related U.S. Application Data

(60) Provisional application No. 60/570,647, filed on May 12, 2004.

(51) Int. Cl.
*A63B 27/00* (2006.01)

(52) U.S. Cl. ..... 182/136; 182/133; 182/134; 248/243; 248/245

(58) Field of Classification Search ..... 248/243–245, 248/200, 200.1, 218.4, 219.3, 226.11, 228.1; 182/133, 141, 150, 187, 228.4; 254/106
See application file for complete search history.

(56) References Cited

U.S. PATENT DOCUMENTS 1,462,878 A * 7/1923 Williamson ..... 254/106
1,597,095 A * 8/1926 Martinsen ..... 248/246
1,754,942 A * 4/1930 Goldsmith ..... 52/696
3,977,640 A * 8/1976 Arnold et al. ..... 248/542
4,463,828 A * 8/1984 Anderson ..... 182/136
4,942,941 A * 7/1990 Anderson ..... 182/136
6,082,060 A * 7/2000 Bauer et al. ..... 52/173.3
6,241,045 B1 * 6/2001 Reeve et al. ..... 182/9
6,273,381 B1 * 8/2001 Riblet ..... 248/248
6,711,867 B1 * 3/2004 Smith ..... 52/696

* cited by examiner

*Primary Examiner*—Katherine W Mitchell
*Assistant Examiner*—Colleen M Quinn
(74) *Attorney, Agent, or Firm*—Ansel M. Schwartz

(57) ABSTRACT

A pump jack for a scaffold in a system to support a work platform and move the platform up and down a pole to access a vertical work surface. The pump jack includes an L-shaped framework having a horizontal frame member which supports the work platform and a vertical frame member. The vertical frame member having laterally opposing Z-shaped channels, each having a leg that bends about the pole and extends inward toward the pole. The pump jack includes an upper shackle supported by the framework. The pump jack includes a lower shackle supported by the framework, which with the upper shackle applies a coupling force for gripping the pole. The pump jack includes a pump arm lever pivotably coupled to the vertical frame member to step upwardly the pump jack relative to the pole. The pump jack includes a crank mechanism coupled to the vertical frame member. A method for supporting and moving a work platform up and down a pole to access a vertical work surface.

7 Claims, 8 Drawing Sheets

PUMP JACK AND METHOD

This application claims the benefit of U.S. Provisional Application No. 60/570,647 filed May 12, 2004.

CROSS-REFERENCE

This application is related to contemporaneously filed U.S. patent application Ser. No. 11/122,360, titled "Pump Jack Crank and Method", by Thomas W. Parker, incorporated by reference herein.

FIELD OF THE INVENTION

The present invention is related to a pump jack for a scaffolding system. More specifically, the present invention is related to a pump jack for a scaffolding system having Z-shaped channels.

BACKGROUND OF THE INVENTION

The application of a work platform forces to the pump jack "L" frame result in significant stresses in the material and fasteners located at the connection of the vertical and horizontal members. FIG. 2 shows that the "L" frame design currently employed by pump jack manufacturers utilizes outwardly opened, laterally opposing, "C" shaped channels for both the vertical 10 and horizontal 11 frame members. At the connection of the vertical and horizontal members, the flange of the vertical member 10 must be notched 12, or removed as shown in FIG. 3, to facilitate the connection of the horizontal member 11. The notching 12, or removal, of the flange in this area weakens the frameworks at its most structurally critical location in two ways:

1. The removal of flange material in the area local to the most significant stresses.
2. The notching process generates a point where stresses are concentrated. This point 13 is located at the corner of the notch 12. This point 13 of concentrated stress is commonly referred to as a stress riser.

As a result, under test loads, the "L" frame vertical member 10 will fail in this structurally critical area.

SUMMARY OF THE INVENTION

The present invention pertains to a pump jack for a scaffold in a system to support a work platform and move the platform up and down a pole to access a vertical work surface. The pump jack comprises an L-shaped framework having a horizontal frame member which supports the work platform and a vertical frame member. The vertical frame member having laterally opposing Z-shaped channels, each having a leg that bends about the pole and extends inward toward the pole. The pump jack comprises an upper shackle supported by the framework. The pump jack comprises a lower shackle supported by the framework, which with the upper shackle applies a coupling force for gripping the pole. The pump jack comprises a pump arm lever pivotably coupled to the vertical frame member to step upwardly the pump jack relative to the pole. The pump jack comprises a crank mechanism coupled to the vertical frame member.

The present invention pertains to a method for supporting and moving a work platform up and down a pole to access a vertical work surface. The method comprises the steps of placing the work platform on a horizontal frame of a pump jack of an L-shaped framework of a pump jack. There is the step of pumping a pump arm lever coupled to a vertical frame member of the framework to move the pump jack up the pole, where the vertical frame member has laterally opposing Z-shaped channels, each having a leg that bends about the pole and extends inward toward the pole.

DETAILED DESCRIPTION

Figure 1:
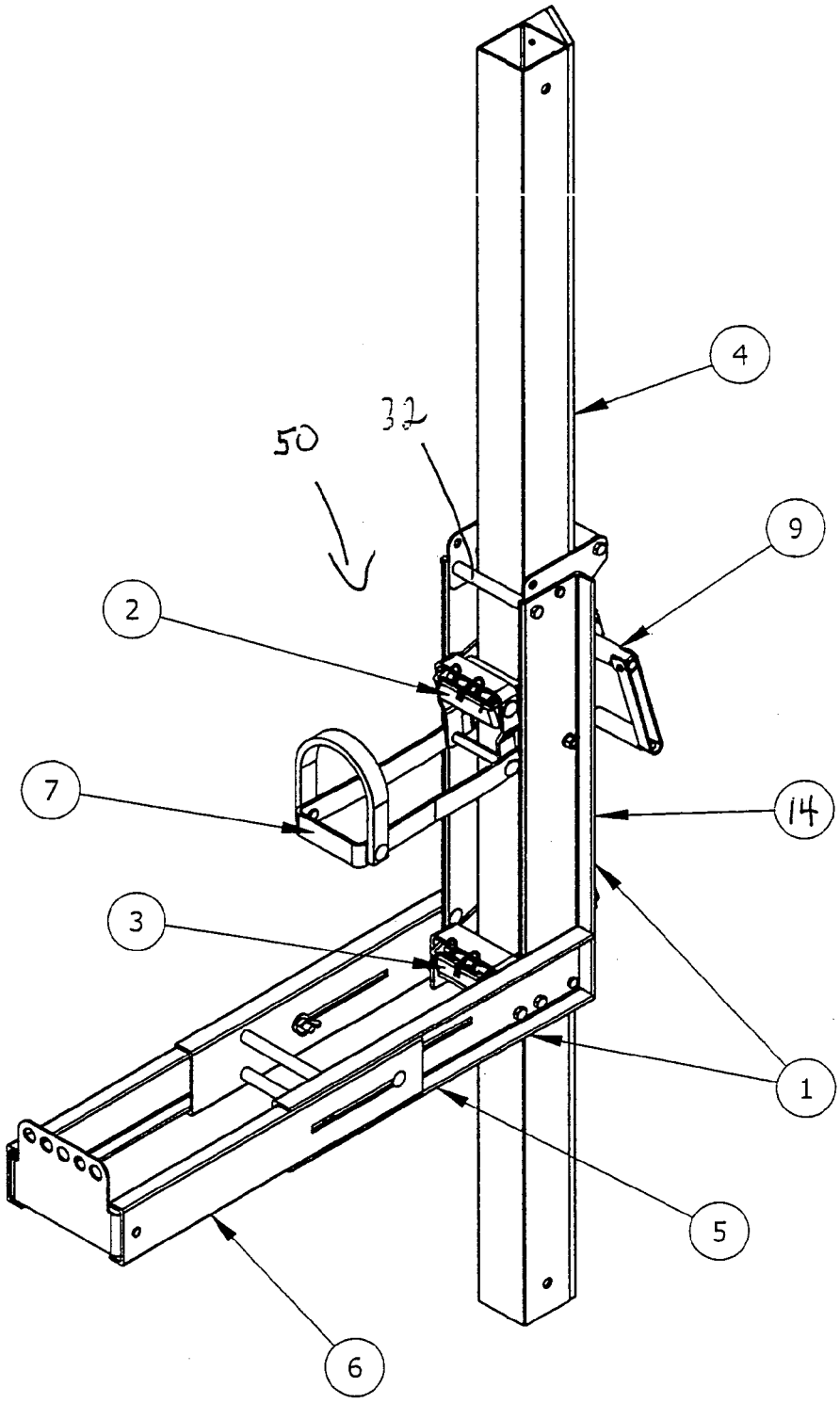
FIG. 1: is a perspective view of the pump jack in accordance with the embodiment of the invention
Figure 2:
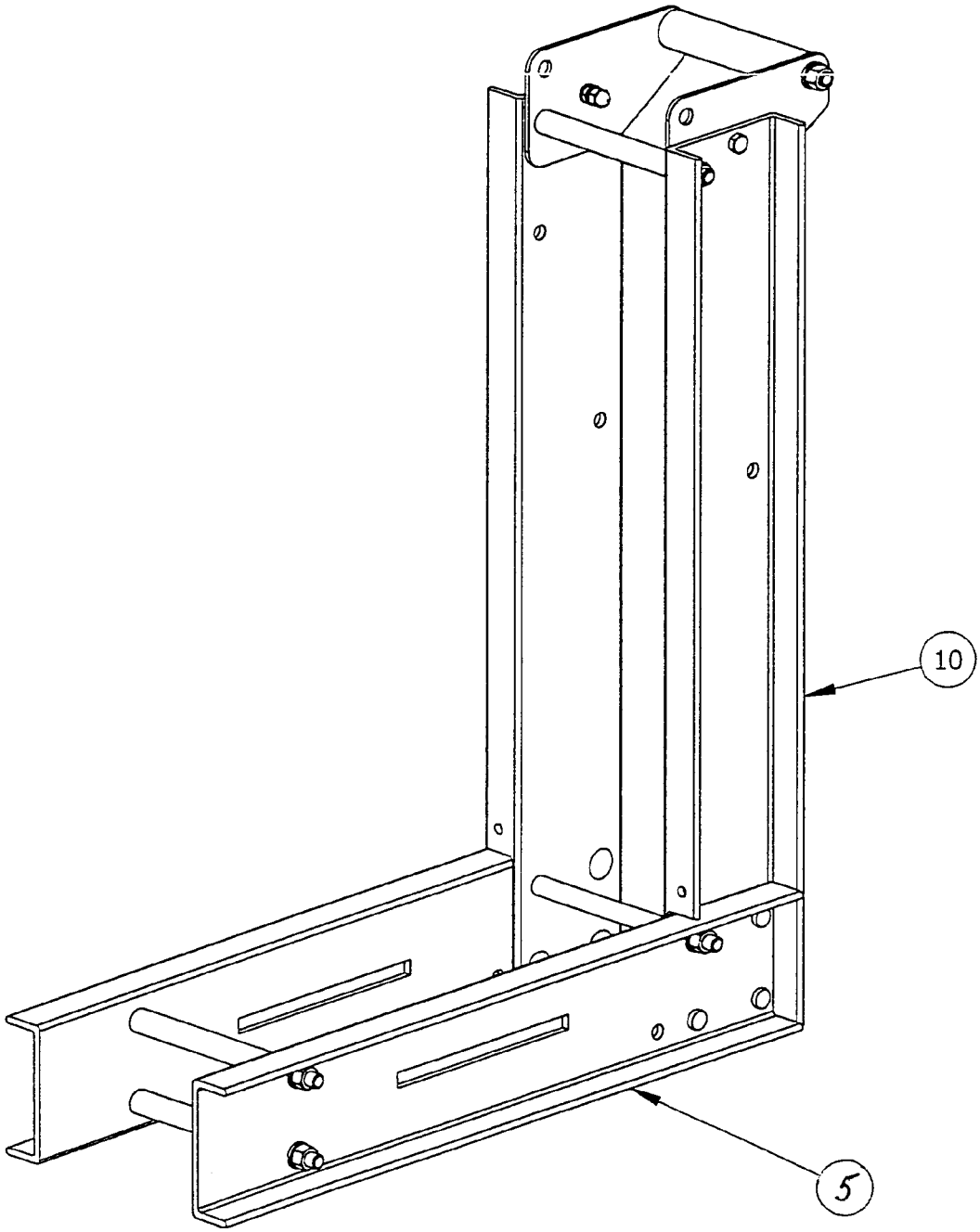
FIG. 2: is the L-shaped design currently employed by pump jack manufacturers
Figure 3:
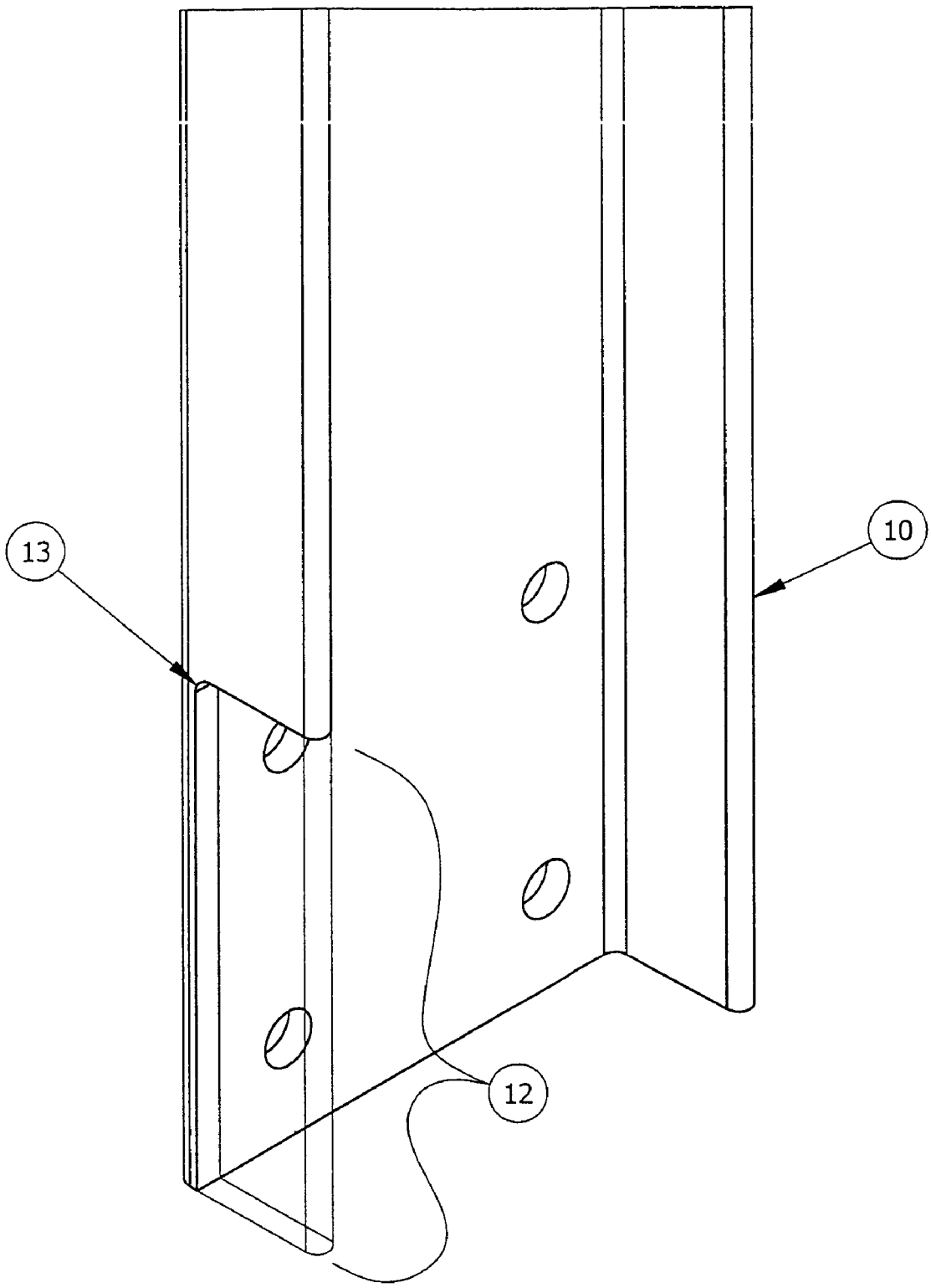
FIG. 3: is a close up view of the vertical frame members in FIG. 2
Figure 5:
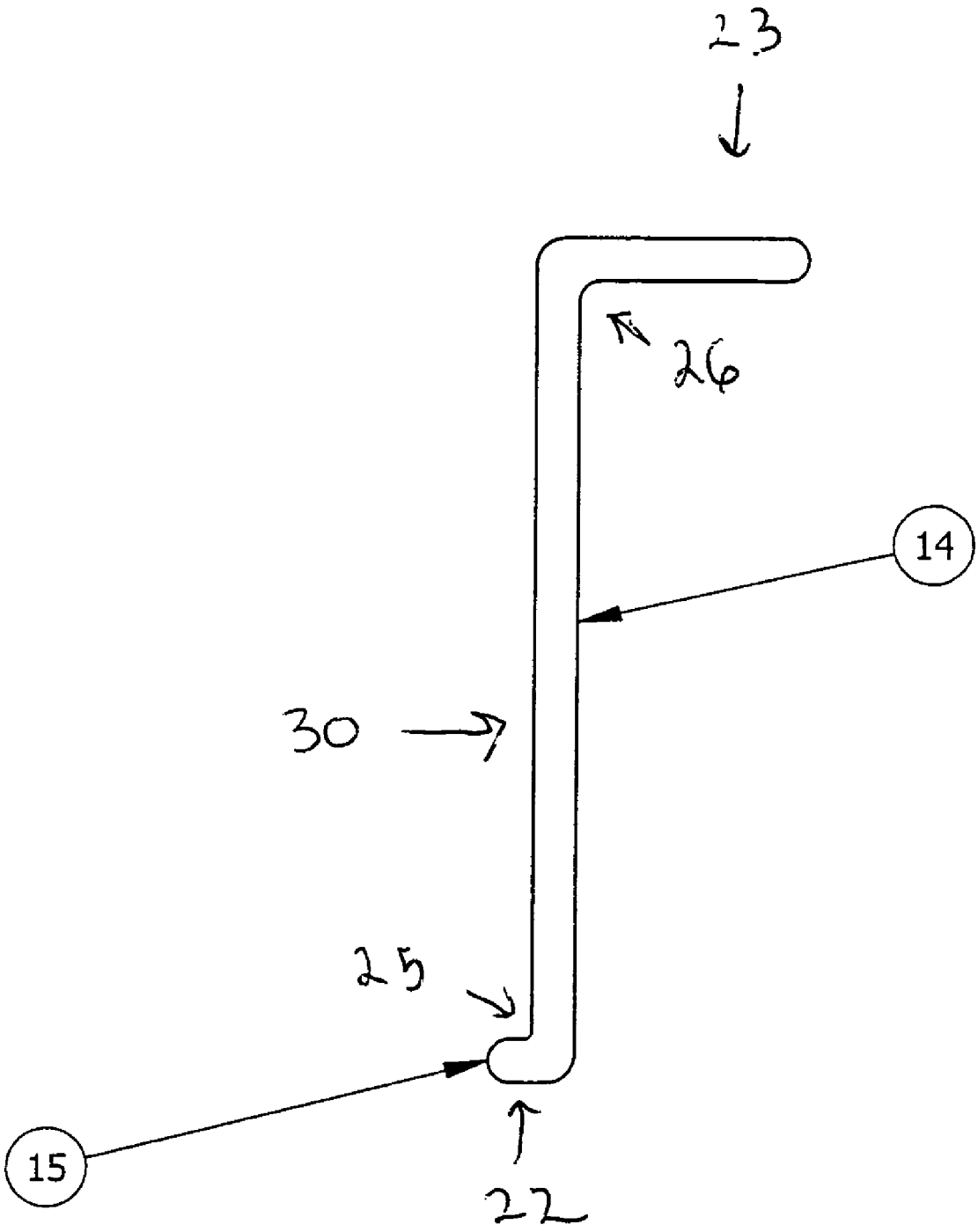
FIG. 5: is a cross-section of the Z-shaped channel members of the pump jack of FIG. 1

Referring now to the drawings wherein like reference numerals refer to similar or identical parts throughout the several views, and more specifically to FIG. 1 thereof, there is shown a pump jack 50 for a scaffold in a system to support a work platform and move the platform up and down a pole 4 to access a vertical work surface. The pump jack 50 comprises an L-shaped framework 1 having a horizontal frame member 5 which supports the work platform and a vertical frame member 14. The vertical frame member 14 has laterally opposing Z-shaped channels 14, each having a leg 22, as shown in FIG. 5, that bends about the pole 4 and extends inward toward the pole 4. The pump jack 50 comprises an upper shackle supported by the framework 1. The pump jack 50 comprises a lower shackle supported by the framework 1, which with the upper shackle applies a coupling force for gripping the pole 4. The pump jack 50 comprises a pump arm lever 7 pivotably coupled to the vertical frame member 14 to step upwardly the pump jack 50 relative to the pole 4. The pump jack 50 comprises a crank mechanism 9 coupled to the vertical frame member 14.

Figure 6:
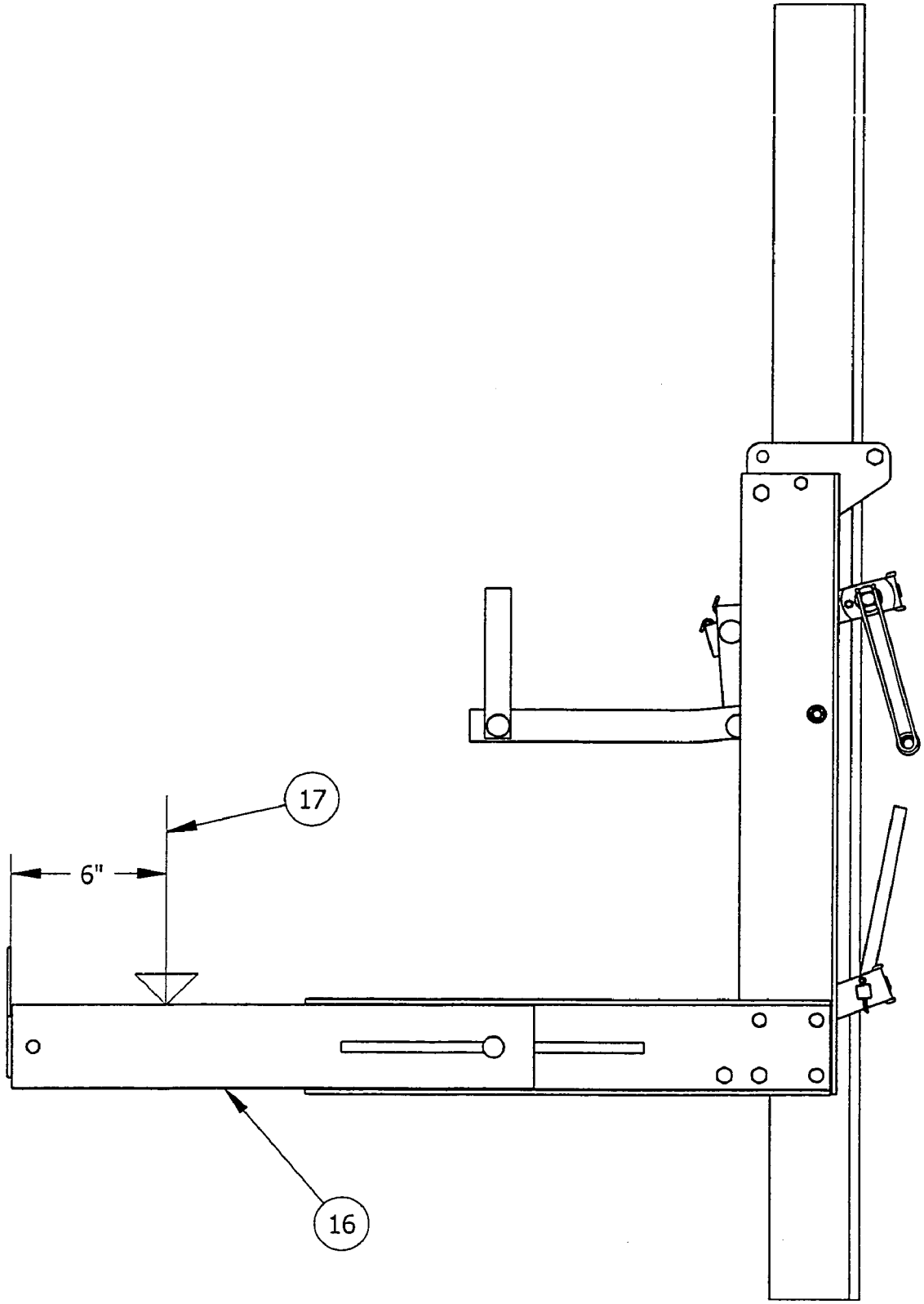
FIG. 6: is a side view of the pump jack of FIG. 1 showing a load applied to the horizontal frame members

Preferably, the framework 1 includes a vertical frame member 14 having a separator 32 extending between and connected to the opposing Z-shaped channels 14, the separator 32 maintaining the Z-shaped channels 14 in a spaced relationship. Each Z-shaped channel preferably has a web 30 with a first side 25 from which the leg 22 bends about the pole 4 and extends inward toward the pole 4, and a second side 26 from which a second leg 23 extends outward away from the pole 4. Preferably, the leg 22 and the second leg 23 extend in opposite directions from each other relative to the pole 4. The horizontal frame member 5 preferably supports the vertical load 17 of at least 2,750 pounds, as shown in FIG. 6.

The present invention pertains to a method for supporting and moving a work platform up and down a pole 4 to access a vertical work surface. The method comprises the steps of placing the work platform on a horizontal frame of a pump jack 50 of an L-shaped framework 1 of a pump jack 50. There is the step of pumping a pump arm lever 7 coupled to a vertical frame member 14 of the framework 1 to move the pump jack 50 up the pole 4, where the vertical frame member 14 has laterally opposing Z-shaped channels 14, each having a leg 22 that bends about the pole 4 and extends inward toward the pole 4.

Preferably, there is the step of supporting a vertical load 17 of at least 2,750 pounds with the horizontal frame member 5.

In the operation of the present invention, a pump jack 50 scaffolding system is designed to support a work platform and move said platform up and down a pole 4 to access a vertical work surface. A pump jack 50 as shown in FIG. 1 includes an "L" shape framework 1 which supports upper 2 and lower 3 spring biased shackles which apply a coupling force for gripping the pole 4. The horizontal member 5 of the pump jack 50 frame includes a slidably adjustable member 6 which supports a work platform and adjusts to a range of platform widths. A pump arm lever 7 is pivotally coupled to the vertical frame member 14 and the upper shackle 2 and is used to step upwardly the pump jack 50 relative to the pole 4. A release mechanism is coupled to the lower shackle 3 for disengaging it from the pole 4. A crank mechanism 9 coupled to a rod is used to roll the pump jack 50 down the pole 4 while the lower shackle 2 is disengaged.

Figure 4:
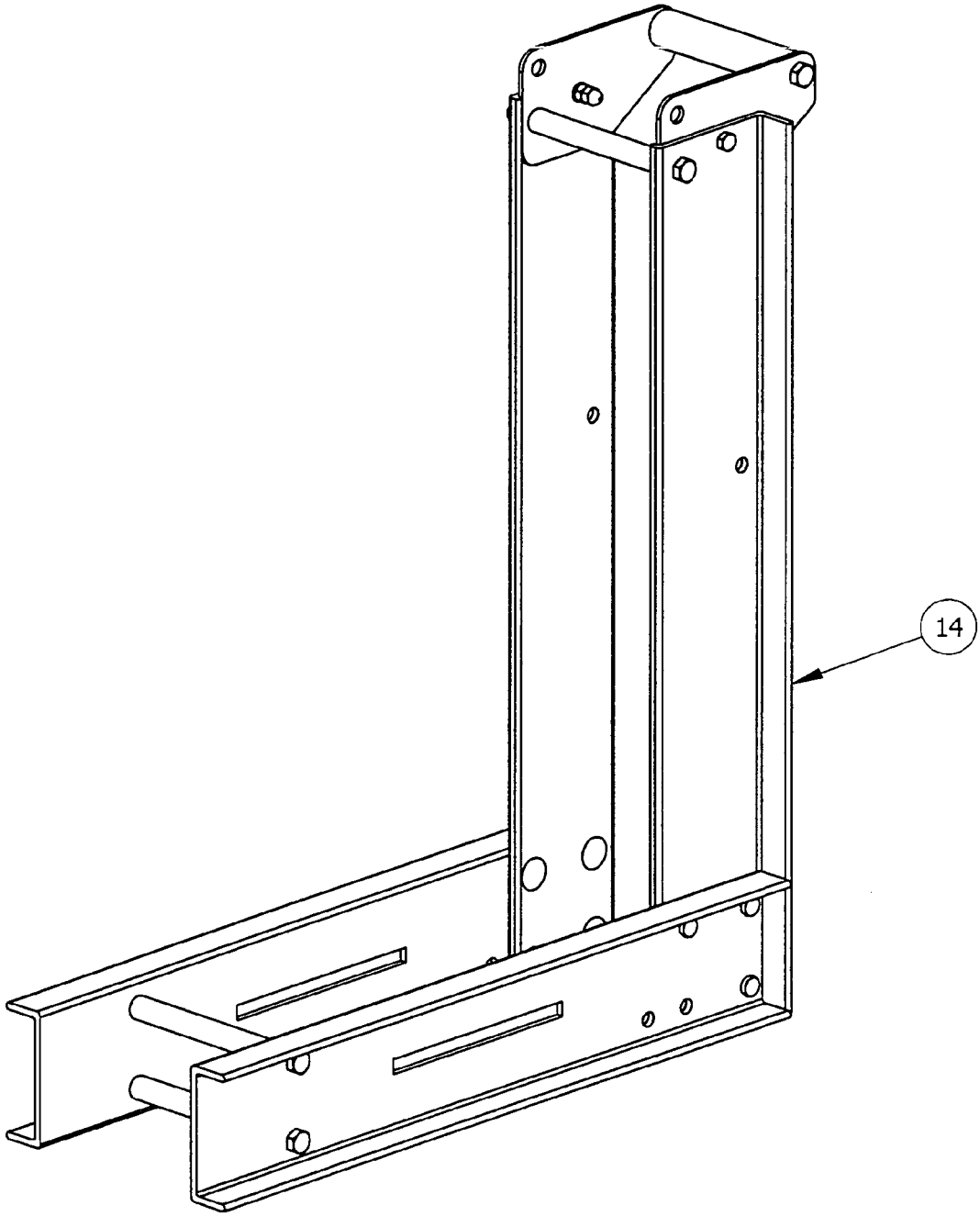
FIG. 4: is a perspective view of the frame work of pump jack embodiment of FIG. 1

The present invention replaces the "C" shaped profile used for the vertical channel 10, as previously described, with laterally opposing, modified "Z" shaped channels 14, as shown in FIG. 4. The pump jack 50 with modified "Z" shaped channel vertical channel 14 eliminates the required notching process 12, thus eliminating the resulting stress riser 13, and adds material 15 in the area local to the most significant stresses as shown in FIG. 5. This structural improvement has no affect on the functional requirements of the pump jack 50. The resulting is a lighter and stronger "L" frame.

The present invention was verified in the Werner Test Lab using current pump jack 50 manufacturer's products and pump jacks 50 with minimum profile thicknesses. The respective pump jacks 50 were tested in both static and cyclic loading.

FIG. 6 shows the static test load set-up. The horizontal platform supports 16 were fully extended and vertical loading 17 was applied. The current manufacturer's product's vertical frame member 10 failed at the connection of the horizontal frame member 5 at a vertical load 17 of 2269 pounds. The pump jack 50 did not fail but reached the vertical load 17 capacity of the test equipment of 2750 pounds.

The cyclic load test was set-up as shown in FIG. 6 with a vertical load 17 of 500 pounds applied repeatedly. The current manufacturer's product's vertical frame member 10 failed at the connection of the horizontal frame member 5 at 34,115 and 85,327 load cycles respectively for two samples tested. In both samples tested, the failure originated at the stress riser 13, created by the notching process 12, then propagated across the horizontal frame member 5. The pump jack 50 did not fail and the test was terminated at 200,000 cycles with no visual signs of weakening of the vertical frame member 14 or the connection to the horizontal frame member.

Figure 7:
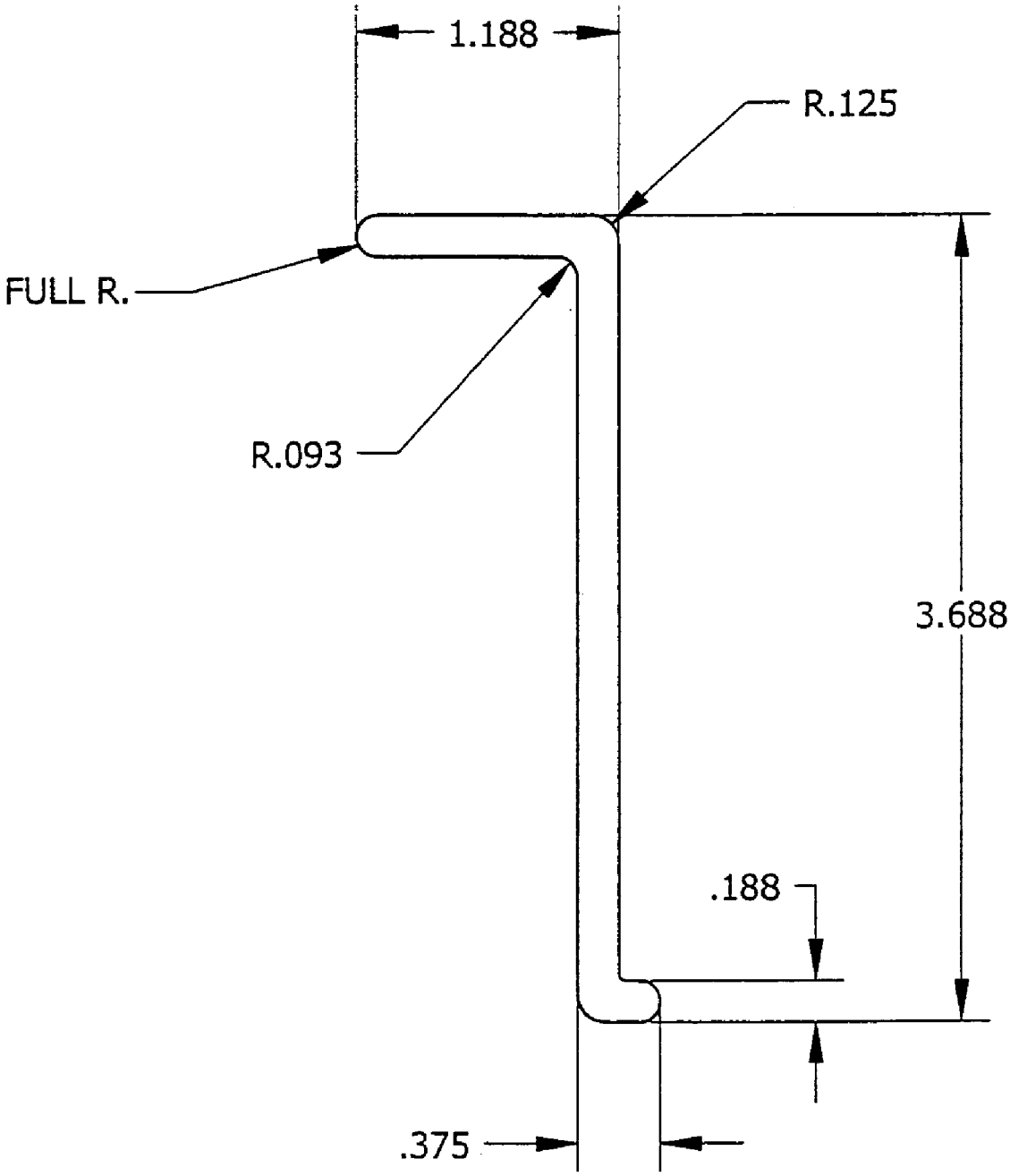
FIG. 7: is a -section of the Z-shaped channel members of the pump jack of FIG. 1 with dimensions included
Figure 8:
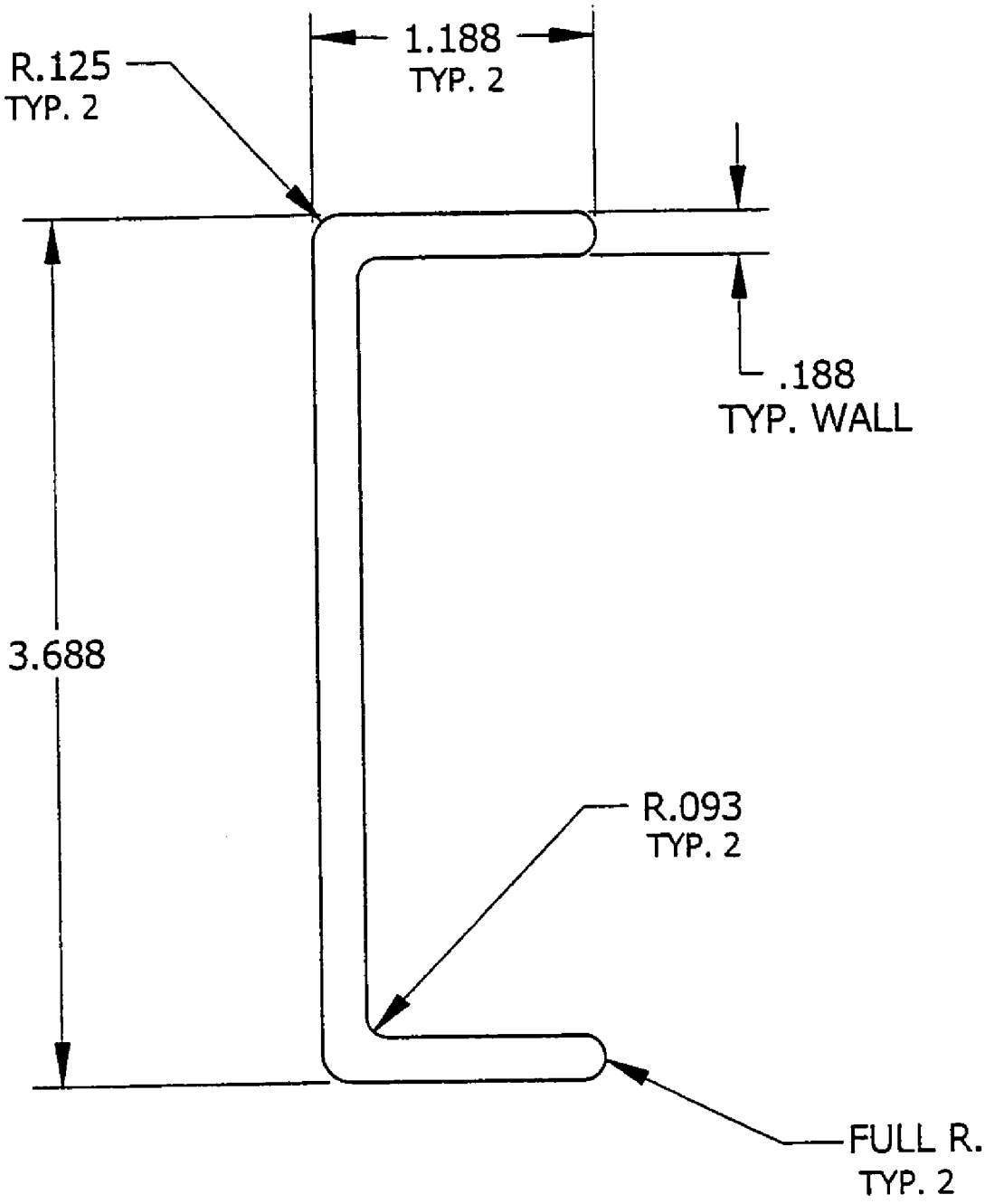
FIG. 8: is a -section of the C-shaped channel members of the pump jack of FIG. 2 with dimensions included

The competitor's material was tested for chemical composition as well as mechanical properties by the Werner Co. Lab. The material was identified as the equivalent of Werner alloy 6105-T6 with ultimate tensile strength (UTS)=41484 psi, yield strength (0.2% YS)=38609 psi, % elongation=9.7. The pump jacks 50 were of alloy 6105-T6 with UTS=40083 psi, 0.2% YS=37547 psi, % elongation 12.6%. So, actually the competitor's material mechanical properties were slightly better. The pump jack 50 profiles were extruded at minimum material, whereas the competitors were extruded with normal manufacturing tolerances. FIG. 7 shows a Z channel profile with dimensions and FIG. 8 shows a C channel profile with dimensions.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A pump jack for a scaffold in a system to support a work platform and move the platform up and down a pole to access a vertical work surface comprising:

an L-shaped framework having a horizontal frame member capable of supporting the work platform and a vertical frame member, the vertical frame member having laterally opposing Z-shaped channel members, each having a leg that bends about the pole and extends inward toward the pole;

an upper shackle supported by the framework;

a lower shackle supported by the framework, which with the upper shackle capable of applying a coupling force for gripping the pole;

a pump arm lever pivotably coupled to the vertical frame member to step upwardly the pump jack relative to the pole; and a crank mechanism coupled to the vertical frame member.

2. A pump jack as described in claim 1 wherein the framework includes a vertical frame member having a separator extending between and connected to the opposing Z-shaped channel members, the separator maintaining the Z-shaped channels in a spaced relationship.

3. A pump jack as described in claim 2 wherein each Z-shaped channel member has a web with a first side from which the leg bends about the pole and extends inward toward the pole, and a second side from which a second leg extends outward away from the pole.

4. A pump jack as described in claim 3 wherein the leg and the second leg extend in opposite directions from each other relative to the pole.

5. A pump jack as described in claim 4 wherein the horizontal frame member supports the vertical load of at least 2,750 pounds.

6. A method for supporting and moving a work platform up and down a pole to access a vertical work surface comprising the steps of:

placing the work platform on a horizontal frame of a pump jack of an L-shaped framework of a pump jack; and pumping a pump arm lever coupled to a vertical frame member of the framework to move the pump jack up the pole, where the vertical frame member has laterally opposing Z-shaped channel members, each having a leg that bends about the pole and extends inward toward the pole.

7. A method as described in claim 6 including the step of supporting a vertical load of at least 2,750 pounds with the horizontal frame member.

* * * * *